United States Patent [19]

Koenig

[11] 4,293,752

[45] Oct. 6, 1981

[54] SELF ADHERING TAPE SWITCH

[75] Inventor: Robert H. Koenig, Huntington Hills, N.Y.

[73] Assignee: Tapeswitch Corporation of America, Farmingdale, N.Y.

[21] Appl. No.: 111,279

[22] Filed: Jan. 11, 1980

[51] Int. Cl.[3] ..... H01H 13/16; H01H 3/14

[52] U.S. Cl. ..... 200/295; 200/294; 200/333; 200/86 R; 174/117 A

[58] Field of Search ..... 340/666; 174/117 A; 200/85 R, 85 A, 86 R, 86 A, 86.5, 153 C, 159 B, 245, 293, 294, 295, 301, 333

[56] References Cited

U.S. PATENT DOCUMENTS

| | | | |
|---|---|---|---|
| 2,770,696 | 11/1956 | Koenig | 200/86 R |
| 2,938,977 | 5/1960 | Koenig | 200/86 R |
| 3,029,303 | 4/1962 | Severino | 174/117 A |
| 3,052,772 | 9/1962 | Koenig | 200/86 R |
| 3,710,054 | 1/1973 | Koenig | 200/86 R |
| 3,812,313 | 5/1974 | Wolf | 200/86 R |
| 3,978,297 | 8/1976 | Lynn | 200/86 R |

FOREIGN PATENT DOCUMENTS

| | | | |
|---|---|---|---|
| 2368813 | 5/1978 | France | 174/117 A |

OTHER PUBLICATIONS

Ribbon Switches, Tapeswitch Corporation of America, NY, Industrial Catalogue C-8-p. 1, TCA 578, 6/13/79.

*Primary Examiner*—Gerald P. Tolin

*Attorney, Agent, or Firm*—James P. Malone

[57] ABSTRACT

Self adhering tape switch or ribbon switch assembly is provided including a tape switch strip. A layer of deformable material bonds to the underside of said tape switch. A layer of pressure sensitive adhesive is applied to the underside of the deformable material layer. A removable strip of paper adheres to the underside of the pressure sensitive adhesive. It is notched to permit coiling.

4 Claims, 5 Drawing Figures

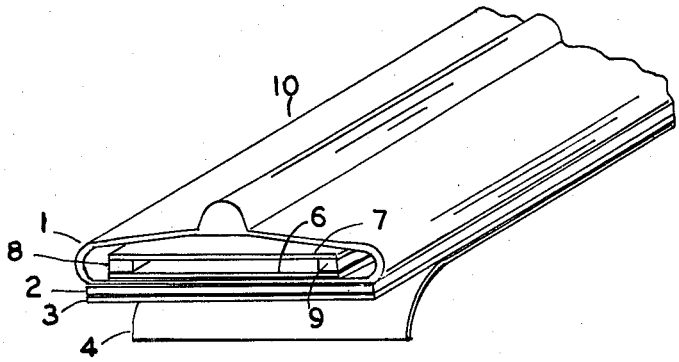
FIG 1
FIG 3
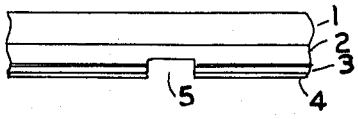
FIG 2
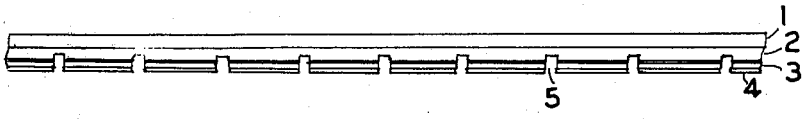
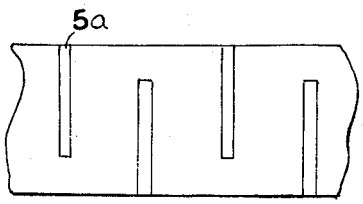
FIG 4
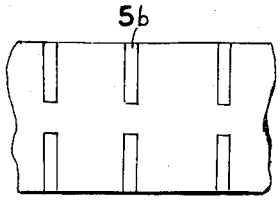
FIG 4A

SELF ADHERING TAPE SWITCH

TECHNICAL FIELD

This invention relates to electrical tape switches and/or ribbon switches and more particularly to such switches with self adhesive mounting.

BACKGROUND ART

Tape switches and/or ribbon switches are used on a variety of control applications, for instance, they are installed on doors, machinery, equipment and under rugs to control the doors, machinery, equipment or operate burglar alarms, etc. Conventional tape switches generally comprise a pair of tapes or ribbons which are separated by one or more insulating strips so that they are not in contact. The assembly is covered by a plastic cover. When the tape switch is pressed at any point along its length by a hand, foot, vehicle wheel, etc., the contact will be made for controlling another circuit, for instance, for opening doors, operating burglar alarms and lights, operating counters, etc. Conventional tape switches are shown in my prior patents, U.S. Pat. Nos. 2,938,977; 3,052,772 and 3,710,054.

DISCLOSURE OF THE INVENTION

Troubles have been encountered with difficulty in fastening on mounting surfaces over any considerable time using self-stick adhesives which have release paper and difficulty in coiling longer lengths of tape switch. The difficulty of adhesion and coiling longer lengths of ribbon switch is surmounted by use of an intermediate foam layer and notching.

The problems of the prior art which are overcome by the present invention are:

1. Degrading of the adhesive because of leaching action from the plasticizer in the body of the product at its solid surface interface with the adhesive.

2. Faulty long term holding because slight irregularities in the mounting surface would pull away from the firm surface of the switch which tends to be rigid.

3. Longer lengths which require coiling caused the protective paper to buckle due to differing radii at surfaces. This caused exposure of the adhesive and also unsightliness.

Accordingly, a principal object of the invention is to provide new and improved tape switch and/or ribbon switch means.

Another object of the invention is to provide new and improved self adhesive tape switches.

Another object of the invention is to provide new and improved self adhering tape switch assembly comprising, a tape switch strip, a layer of deformable material adhering to the underside of said tape switch, a layer of pressure sensitive adhesive adhering to the underside of said deformable material layer.

These and other objects of the invention will be apparent from the following specification and drawings of which:

BRIEF DESCRIPTION OF THE DRAWINGS:

FIG. 1 is a perspective view of an embodiment of the invention.

FIG. 2 is a side view of the embodiment of FIG. 1.

FIG. 3 is an enlarged detail view of a portion of FIG. 2.

FIGS. 4 and 4A show underside plan views of slot configurations.

BEST MODE FOR CARRYING OUT THE INVENTION:

Referring to FIG. 1, the tape switch 1, is conventional and comprises a pair of ribbon contacts 6 and 7, which are separated by a pair of insulating strips 8 and 9. This assembly is enclosed in an outer plastic cover 10.

According to the present invention, a layer of deformable material 2, is bonded to the underside of the cover 10. A strip of pressure sensitive adhesive is adhesively mounted to the underside of the layer 2. A paper strip 4, is adhesively mounted on the underside of the adhesive strip 3.

When it is desired to mount the tape switch on a surface the paper 4, is peeled off and the tape switch assembly is pressed into place.

The deformable material strip 2, may be closed cell polyvinylchloride, PVC sponge or foam. The adhesive strip 3, having adhesive on both sides, may be of plastic and is commercially available.

In order to permit coiling of the tape switch without buckling the assembly, spaced notches 5, are cut through the paper 4, the adhesive strip 3, and partially through the deformable layer 2. The cut configurations shown in FIGS. 4 and 4A permit peeling off the paper in one piece from a length.

In practice, the foam layer 2, should be the order of 1/16 inch thick. Notches 5, can be $\frac{1}{8}$ inch wide, spaced approximately two inches, and any depth into the foam layer 2. The adhesive layer 3, may be synthetic rubber adhesive. The bond between tape switch 1, and sponge layer 2, may be achieved by solvent bonding using a solvent as for example, tetrahydrofurane.

By using the technique shown in this invention, a layer of foam which by chemical solvent bonding is adhered molecularly to the PVC jacket of the product. With synthetic rubber adhesive on the new surface, the leaching deterioration is eliminated. The sponge layer 2, by its nature conforms to surface irregularities, giving quick, near perfect bonding to any firm dry surface.

The optional slot configurations 5*a*, 5*b*, shown in FIGS. 4 and 4A permit the coiling without buckling of the release paper and foam. It also permits peeling the release paper in a continuous strip instead of short segments.

In order to install the switch, the protective paper is peeled off and the assembly is pressed into place. The assembly will then be adhesively bonded to the mounting surface.

What is claimed is:

1. Self adhering tape switch assembly comprising: a tape switch having a pair of switch contacts, a layer of deformable material bonded to the underside of said tape switch, a layer of pressure sensitive adhesive connected to the underside of said deformable material layer, a strip of paper adhering to the underside of the pressure sensitive adhesive, said paper strip being removable, a plurality of spaced notches cut through the paper and pressure sensitive adhesive layer so that the tape switch assembly can be easily coiled.

2. Apparatus as in claim 1 wherein the layer of deformable material is closed cell polyvinylchloride sponge.

3. Apparatus as in claim 2 wherein the polyvinylchloride sponge is adhered to the tape switch assembly by solvent bonding.

4. Apparatus as in claim 3 wherein the solvent bonding agent is tetrahydrofurane.

* * * * *